United States Patent [19]

Goodman et al.

[11] Patent Number: 5,050,846

[45] Date of Patent: Sep. 24, 1991

[54] ADJUSTABLE LENGTH, NON-MECHANIZED PEDESTRIAN TRAFFIC BARRIER SYSTEM

[75] Inventors: Charles S. Goodman, Mount Kisco; Richard P. Whalen, Hopewell Junction, both of N.Y.

[73] Assignee: Ship'n Out Company, Brewster, N.Y.

[21] Appl. No.: 607,530

[22] Filed: Nov. 1, 1990

[51] Int. Cl.[5] ..... E04H 17/00

[52] U.S. Cl. ..... 256/1; 49/34

[58] Field of Search ..... 256/1; 49/9, 34; 160/351; 404/6, 7; 24/17 A, 17 B, 306, 442

[56] References Cited

U.S. PATENT DOCUMENTS

| | | | |
|---|---|---|---|
| 193,573 | 7/1879 | Tripp | 160/25 |
| 376,436 | 1/1888 | Harrison | 160/24 |
| 1,832,271 | 11/1931 | Williams | 49/34 X |
| 2,392,755 | 1/1946 | Michaels | 49/34 |
| 2,499,898 | 3/1950 | Anderson | 24/442 |
| 3,314,468 | 4/1967 | Riedel | 160/24 |
| 3,408,771 | 11/1968 | Garrett et al. | 49/34 |
| 3,782,766 | 1/1974 | Teel | 256/1 X |
| 3,917,231 | 11/1975 | Fink | 49/34 |
| 4,105,190 | 8/1978 | Curtis | 256/1 |
| 4,124,196 | 11/1978 | Hipskind | 256/1 |
| 4,186,912 | 2/1980 | Byrd, Jr. | 256/1 |
| 4,287,637 | 9/1981 | Bernardi | 256/1 |
| 4,730,810 | 3/1988 | Rambaud | 256/1 X |
| 4,844,420 | 7/1989 | Oster | 256/1 |
| 4,878,274 | 11/1989 | Patricy | 24/306 |

FOREIGN PATENT DOCUMENTS

| | | | |
|---|---|---|---|
| 0287510 | 10/1988 | European Pat. Off. | 49/34 |
| 2178795 | 2/1987 | United Kingdom | 24/442 |

*Primary Examiner*—Andrew V. Kundrat
*Assistant Examiner*—Franco S. De Liguori
*Attorney, Agent, or Firm*—St. Onge Steward Johnston & Reens

[57] ABSTRACT

The present invention relates to a pedestrian traffic barrier system having an elongated strip of flexible material. A first end portion of the flexible material is engaged with a first stationary structure; a second end portion of the material includes an attachment element disposed thereat and a complementary element of the attachment element on the second end portion is disposed along the flexible material at an intermediate segment thereof, such that the second end portion can be attached to the intermediate segment at a plurality of locations; and a second stationary structure engages the flexible material to form a barrier.

18 Claims, 3 Drawing Sheets

ADJUSTABLE LENGTH, NON-MECHANIZED PEDESTRIAN TRAFFIC BARRIER SYSTEM

TECHNICAL FIELD

The present invention relates to a barrier system which can be used for any of various crowd control applications. In particular, this invention relates to a barrier system which comprises a strip of flexible material or tape which extends between stationary means for engagement thereof. The length of the inventive system can be adjusted, yet the disadvantages of mechanized, adjustable length systems are avoided.

In an increasingly busy society, it is becoming more and more necessary for public places such as banks, airports, stores, movie theaters, etc., to control the flow of people in order to maintain an orderly environment. For example, in banks there is often a large number of patrons awaiting service, making it necessary to maintain a single line or series of lines of patrons so as to permit servicing of these individuals in an orderly fashion, as well as in the appropriate order. This is also true for travelers at airports waiting to see an airline representative and shoppers waiting to purchase their goods.

Unfortunately, it is often difficult, if not impossible, to maintain an orderly line of individuals without the use of physical barrier means to maintain the individuals in the desired line or lines.

BACKGROUND ART

Early attempts to construct a portable partition or screen are illustrated by U.S. Pat. No. 193,573 to Tripp, U.S. Pat. No. 376,436 to Harrison, U.S. Pat. No. 3,314,468 to Riedel, U.S. Pat. No. 4,124,196 to Hipskind, and U.S. Pat. No. 4,186,912 to Byrd, Jr. Each of these patents discloses a screen which can restrict the view and access to certain areas or scenes, such as an accident scene. Although portable, the bulkiness and cumbersome handling of these screens make them impractical for use as a crowd barrier system.

Both Williams, in U.S. Pat. No. 1,832,271, and Garrett and Shelton, in U.S. Pat. No. 3,408,771, disclose cords or cables which can extend across aisles or form railings These cords or cables, though, are of a fixed length and the barriers produced therewith are not adjustable without sagging or otherwise becoming aesthetically undesirable and less effective.

Similarly, in U.S. Pat. No. 2,392,755, Michaels discloses a flexible guard railing which can extend across an open space between two stanchions. Fink, in U.S. Pat. No. 3,917,231, discloses a flexible traffic barrier which comprises an elongated strip of flexible material positioned on a reel, carried on a vertical support, such that the flexible material can be unrolled and positioned across an area to provide a barricade. In U.S. Pat. No. 4,844,420, Oster discloses a retractable crowd control barrier which consists of a housing carried on a post or stanchion in which an elongated tape is stored on a spring actuated spool assembly. The tape can be extended from the housing and positioned to guide pedestrian traffic.

Crowd control barrier systems which utilize mechanized devices, such as the spools or reels of Fink and Oster, and which require either manual or other type of actuation, such as spring actuation, have several disadvantages. Most notable of these is the propensity of these reels or spools to break or jam. When this occurs, the entire device must often be completely replaced, frequently at great cost. Additionally, in systems such as those of Fink and Oster, where the barrier material is normally contained in a housing, the physical dimensions of the housing comprise a limitation on the length of the material. Accordingly, the barrier provided is of limited practical usefulness since it is of a limited length. Moreover, in the Fink and Oster systems, the barrier material is permanently mounted to a reel or spool. When this material becomes frayed or otherwise in need of replacement, the entire housing must be replaced.

What is needed, therefore, is an adjustable crowd control system which does not use mechanized means for adjusting the length of the barrier, and which is adapted for facile replacement or reconditioning of the barrier material.

DISCLOSURE OF INVENTION

The present invention relates to a pedestrian traffic barrier system which comprises an elongated strip of flexible material comprising two end portions and an intermediate segment. A first end portion of the flexible material is engaged by a means associated with a first stationary structure. A second end portion of the material has one element of an attachment means disposed thereat. A complementary element or elements of the attachment means is disposed along the flexible material at the intermediate segment, such that the second end portion can be attached to the intermediate segment at a plurality of locations. The barrier system of the present invention also comprises a means associated with a second stationary structure which engages the flexible material to thereby attach the flexible material thereto when the second end portion is attached to the intermediate segment.

In this way, the flexible material extends from the first stationary structure means to the second stationary structure means to form a pedestrian traffic barrier. By adjusting the location at which second end portion of the flexible material is attached to the intermediate segment, the length of the inventive barrier system can be adjusted.

DESCRIPTION OF THE DRAWINGS

The present invention will be better understood and its advantages more apparent in view of the following detailed description, especially when read with reference to the appended drawings, wherein:

FIG. 1*a* is a side plan view of one embodiment of the barrier system of the present invention, having a certain length a;

FIG. 1*b* is a side plan view of the embodiment illustrated in FIG. 1*a*, except having a length b which is shorter than length a;

FIG. 1*c* is a side plan view of the embodiment illustrated in FIG. 1*a*, except having a length c which is shorter than length a or length b;

DETAILED DESCRIPTION OF THE PREFERRED EMBODIMENT

Figure 1:
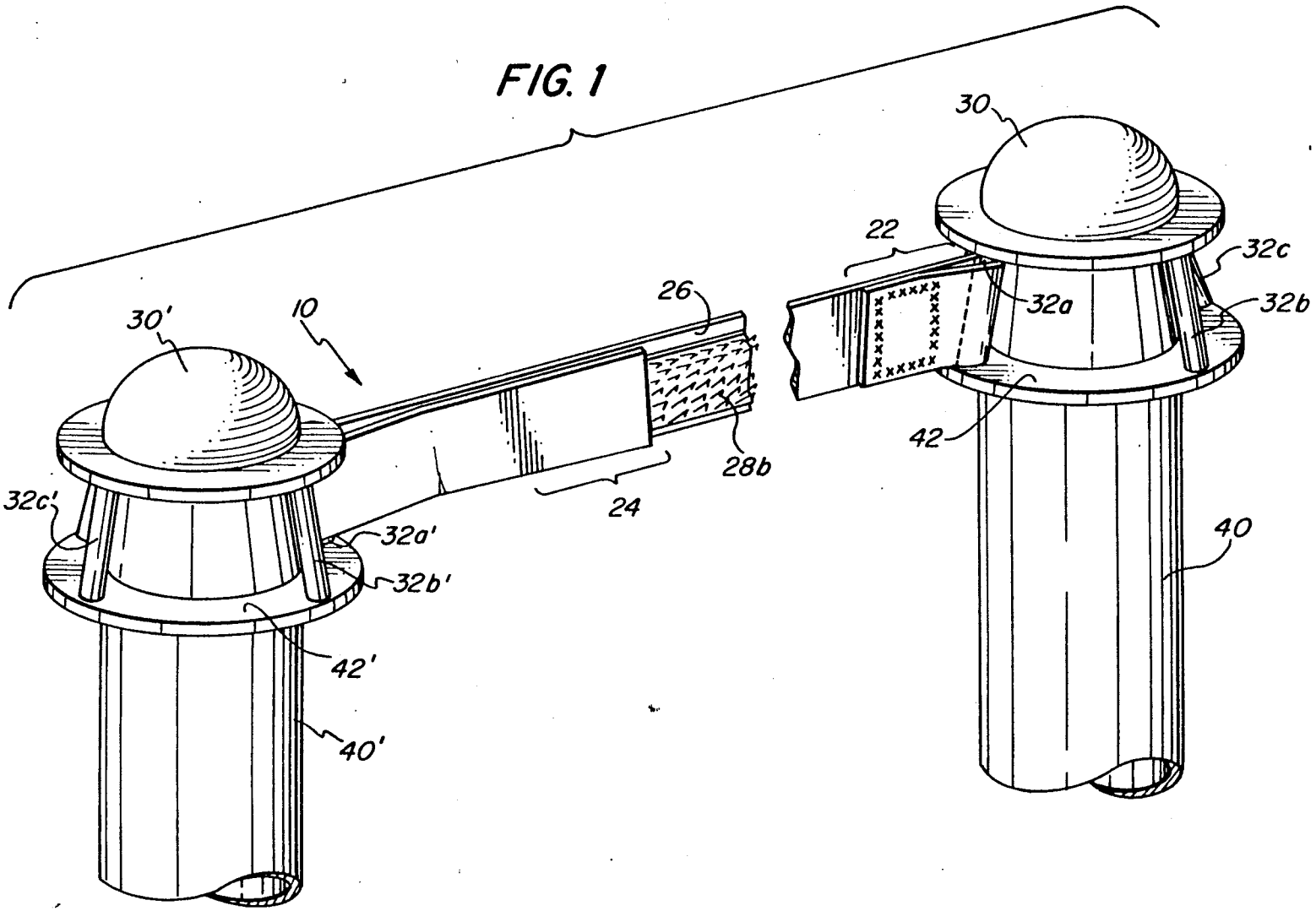
FIG. 1 is a broken-away isometric view of one embodiment of the barrier system of the present invention.

As illustrated in FIG. 1, the present invention relates to a pedestrian traffic barrier or crowd control system 10. For convenience of description, the inventive system will be referred to herein as barrier system 10, although it will be understood that the terms "pedestrian traffic barrier system", "crowd control system", and other terms which will be familiar to the skilled artisan are interchangeable. In addition, the orientation of the component parts of barrier system 10 illustrated in FIGS. 1 through 1*c*, although preferred, is not critical to effective use of barrier system 10. It will be recognized that for the sake of clarity all of the elements of barrier system 10 do not appear in each drawing Figure.

The present invention, more specifically, relates to an elongated strip of flexible material 20 (illustrated in FIG. 2) having a first end portion 22 which is engaged by a means associated with a first stationary structure. A second end portion 24 of flexible material 20 has a first element 28*a* of an attachment means 28 disposed thereat, and complementary element or elements 28*b* of attachment means 28 (depending upon the nature of attachment means 28) are disposed on flexible material 20 at an intermediate segment 26 (by which is meant that segment of flexible material 20 between first end portion 22 and second end portion 24) thereof. This permits attachment of second end portion 24 to flexible material 20 at any of a plurality of locations along intermediate segment 26 via attachment means 28. Flexible material 20 is engaged by (generally by being looped about, as discussed in more detail below) a means associated with a second stationary structure to thereby attach elongated strip 20 thereto when second end portion 24 is attached to intermediate segment 26, in order to form barrier system 10. The fact that second end portion 24 of flexible material 20 can be attached to intermediate segment 26 via attachment means 28 at a plurality of locations along intermediate segment 26 provides desired adjustability in length of barrier system 10.

Figure 2:
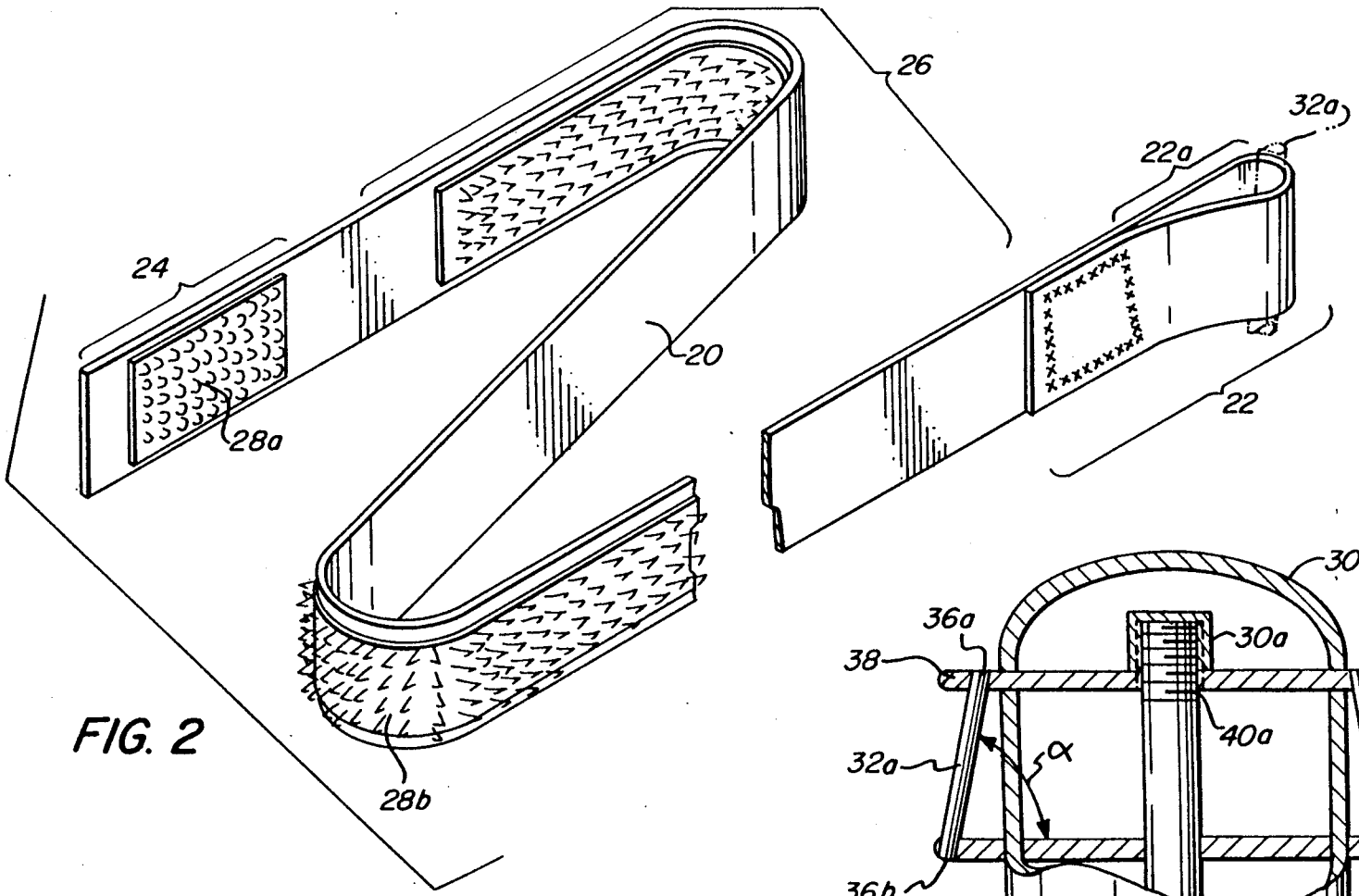
FIG. 2 is a broken-away isometric view of the elongated strip of flexible material of the present invention.

Flexible material 20, as illustrated in FIG. 2, generally comprises an elongated length of nylon or polypropylene webbing material, although other flexible materials, including velvet, leather, rubber or rubberized materials, plastics, and other synthetic and natural materials may also be suitable for use as flexible material 20. In addition, flexible material 20 may have applied thereto or woven therein decorative patterns or writing.

Flexible material 20 is preferably formed as an elongated strip or tape and is sufficiently long to form an effective pedestrian barrier system. Advantageously, flexible material 20 is about 4 feet to about 15 feet in length, and is more preferably greater than about 6 feet and most preferably about 7 feet to about 12 feet in length. The length of flexible material 20 is affected by the fact that the effective length is reduced by the looping of flexible material 20 about the means associated with a second stationary structure (and resultant doubling over) to attach second end portion 24 to intermediate segment 26.

Figure 3:
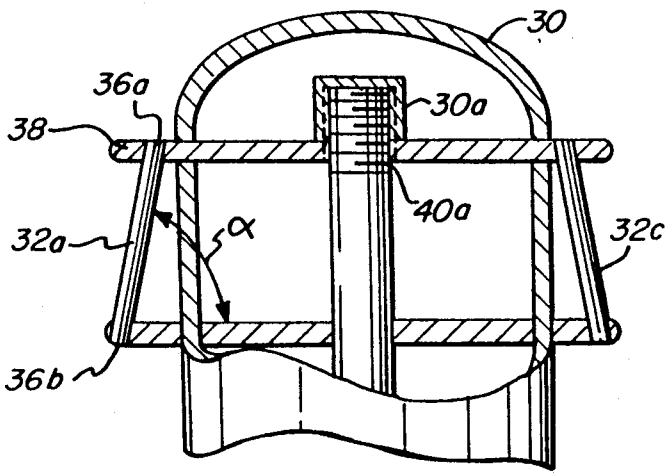
FIG. 3 is a partially broken-away side plan view of one embodiment of a headpiece according to the present invention, mounted on a stanchion.

Flexible material 20 has a first end portion 22 and a second end portion 24, as noted. By end portion is meant that area of flexible material 20 adjacent (i.e., generally within about 6 inches of) its terminal end. First end portion 22 of flexible material 20 is engaged by a means associated with a first stationary structure. Preferably, first stationary structure comprises a headpiece 30 as illustrated in FIGS. 1 and 3. Headpiece 30 is a generally cylindrical fixture which can be mounted on or formed integral with a stanchion 40 or other support, although the particular shape or design of headpiece 30 is not critical to the present invention. Most preferably, headpiece 30 is removably mounted on stanchion 40, such as by internally disposed threaded members 30*a* and 40*a* illustrated in FIG. 3, for convenience of replacement or adjustment.

Headpiece 30 can be formed of any suitable material having the required structural and dimensional stability. Advantageously, headpiece 30 is formed of a metal, such as brass, chrome, steel (especially stainless steel), or aluminum, which can be painted or coated with other materials. In addition, headpiece 30 can be formed of wood or a dimensionally stable plastic, such as high density polyethylene.

Figures 1A, 1B, 1C:
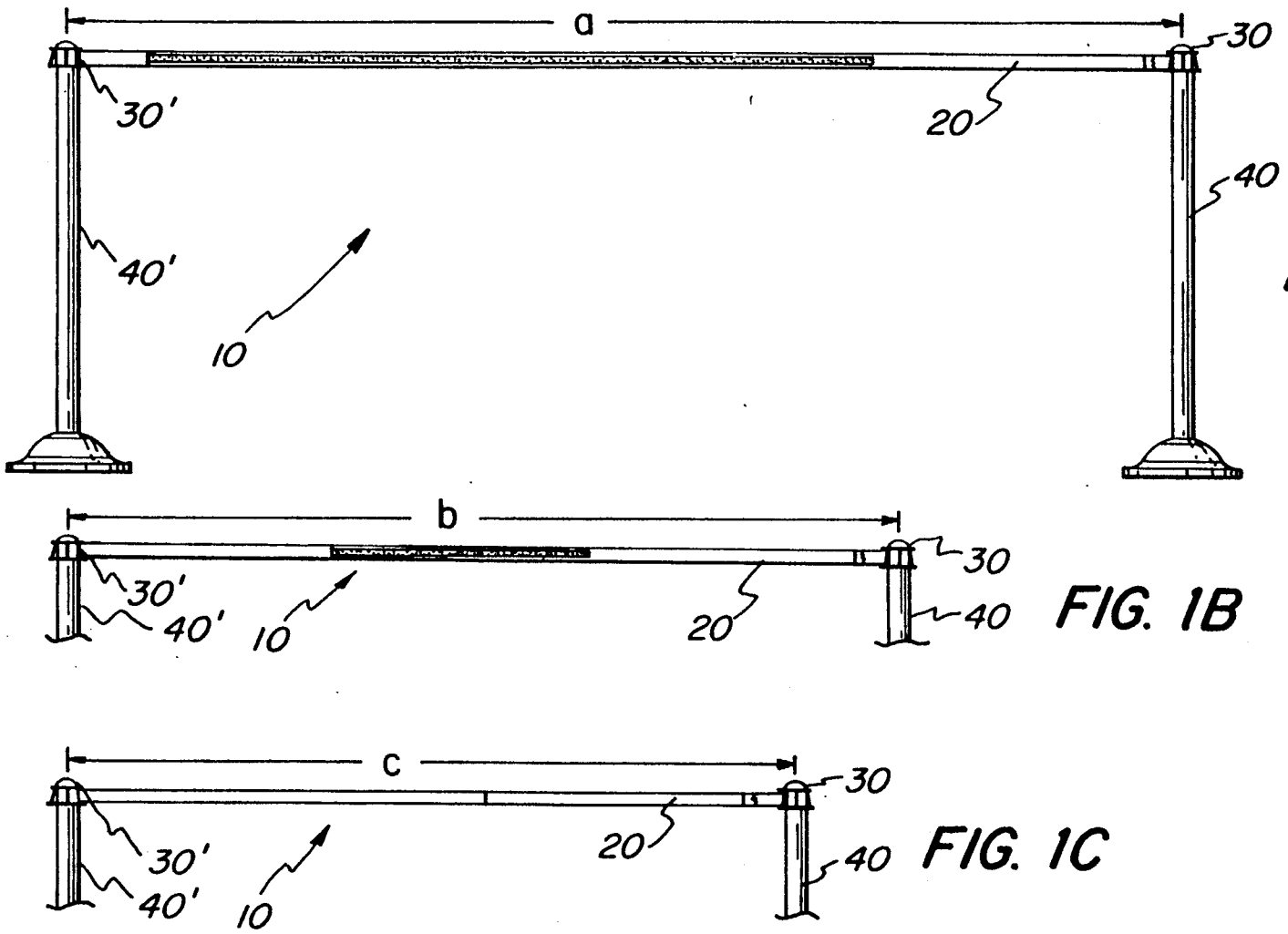

Headpiece 30 has means associated therewith for engagement of first end portion 22 of flexible material 20. Although any suitable means for engagement of first end portion 22 can be employed, preferably such means on headpiece 30 comprises at least one rod 32*a* (illustrated in phantom in FIG. 1) which depends from headpiece 30. It is desirable that rod 32*a* is generally vertical in orientation, in order to maintain flexible material 20 in an upright orientation in barrier system 10, as illustrated in FIGS. 1*a*, 1*b*, and 1*c*.

When the means associated with headpiece 30 comprises rod 32*a* (and thereby attached to headpiece 30) by forming 32*a* (and thereby attached to headpiece 30) by forming first end portion 22 into a loop 22*a* (by which is meant a closed, curved figure) and disposing loop 22*a* about rod 32*a*. Loop 22*a* formed in first end portion 22 is advantageously a sewn or otherwise permanently formed loop to avoid accidental disengagement of flexible material 20 from headpiece 30.

Where headpiece 30 is removably mounted on stanchion 40, disengagement of loop 22*a* can be prevented by buttressing rod 32*a* against a structure 42 of stanchion 40, as illustrated in FIG. 3. In this way, flexible material 20 is removably attached to headpiece 30 since removal of headpiece 30 from stanchion 40 frees rod 32*a* from structure 42, loop 22*a* can be disengaged, which permits easy replacement of flexible strip 20 independent of headpiece 30 if the need to replace it arises through wear, such as fraying, or other damage.

Flexible material 20 also comprises a second end portion 24. Second end portion 24 has disposed thereat a first element 28*a* of attachment means 28. A complementary element or plurality of complementary elements 28*b* (depending on the nature of attachment means 28) is disposed along the length of flexible material 20 at intermediate segment 26. In this way, second end portion 24 can be attached to flexible material 20 at plurality of locations along intermediate segment 26. Appropriate attachment means 28 include hook and loop fastening systems, commercially available as Velcro® fastening systems, buttons, snaps, zippers, hook and eye fastening systems, tabular clasps, and combinations thereof.

If attachment means 28 comprises continuous elements such as Velcro® type hook and loop fasteners or zippers, one of the elements 28*a* is disposed at second end portion 24, such as the loop material, and a continuous strip of the hook material is disposed as complementary element 28*b* along intermediate segment 26, as illustrated in FIG. 2 (in this instance, it can be said that one complementary element 28*b* of attachment means 28 is disposed along intermediate segment 26). Second end portion 24 can then be attached to flexible material 20 in a plurality of locations by contacting the loop material of first element 28*a* with the hook material of complimentary element 28*b* in any location along intermediate segment 26. In the alternative, the strip of complementary element 28*b* can instead be replaced with a series of elements such as discreet hook material patches (not shown). Indeed, if attachment means 28 is one requiring discreet elements 28*a* and 28*b* such as buttons, hook and eye fasteners, snaps, etc., one of the elements 28*a*, such as buttons, is disposed on second end portion 24, whereas the complementary elements 28*b*, such as button holes, are disposed along intermediate segment 26 (in this instance, a plurality of complementary elements 28*b* is utilized).

As illustrated in FIGS. 1*a*, 1*b*, and 1*c*, the attachment of second end portion 24 along intermediate segment 26 at a plurality of locations allows for adjustment of the length of barrier system 10. As illustrated in FIG. 1*a*, when second end portion 24 is attached to intermediate segment 26 at a location more closely adjacent to second end portion 24, the length of barrier system 10 is greater than when second end portion 24 is attached to intermediate segment 26 at a point further therefrom (FIGS. 1*b* and 1*c*). This is caused by the "loss" of length due to the resulting doubling over when second end portion 24 is attached further along intermediate segment 26.

Barrier system 10 of the present invention also comprises a means associated with a second stationary structure about which flexible material 20 is looped. Headpiece 30', illustrated in FIG. 1, preferably acts as the second stationary structure and may be mounted on a stanchion 40'. Advantageously, headpiece 30' is physically configured identical to headpiece 30, illustrated in FIG. 3. Rod 32*a'* depends from headpiece 30' and is the structure about which flexible material 20 is looped.

In use, flexible material 20 encircles rod 32*a'* of headpiece 30' to permit second end portion 24 to attach to intermediate segment 26. Once second end portion 24 has been attached to intermediate segment 26, flexible material 20 is engaged by rod 32*a'* and thereby attached to second headpiece 30', to form barrier system 10 as illustrated in FIG. 1.

In a preferred embodiment of the present invention, each headpiece 30 and 30' comprises a plurality of rods 32*a*, 32*b*, 32*c*, etc., and 32*a'*, 32*b'*, 32*c'*, etc., respectively. Preferably each headpiece 30 and 30' comprises two to five, most preferably four, rods to allow the formation of a series of barrier systems 10, each of which can be interrelated by using a single headpiece as stationary structure in more than one barrier system 10. In this way, pedestrian traffic patterns of varying complexities can be prepared as needed.

It is desirable, from an aesthetic as well as functional viewpoint, to maintain tension on flexible material 20 when disposed in barrier system 10 to maintain flexible material 20 in as close to a vertical orientation as possible. In order to maintain this tension, it is desired that rods 32*a*, 32*b*, 32*c*, etc. (and 32*a'*, 32*b'*, 32*c'*, etc.) be canted, that is, maintained at an angle (illustrated as angle $\alpha$ in FIG. 3), which is less than 90° to the horizontal. In this way, the upper portion of flexible material 20 is subjected to greater tension than the lower portion, which helps to prevent sagging or drooping of flexible material 20.

Although rods 32*a*, 32*b*, 32*c*, etc. can be permanently formed in the desired angle, it is more desirable to maintain pressure on flexible material 20 by subjecting rods 32*a*, 32*b*, 32*c*, etc. to tension themselves, especially spring actuated tension. To accomplish this, one of the ends of each rod can be hinged or otherwise adjustably connected to headpiece 30, with the other end exposed to spring tension. This is illustrated in FIG. 3. The end 36*a* of rod 32*a* is forced by spring 38 to maintain pressure on flexible material 20. Although in this embodiment end 36*a* of rod 32*a* is being forced towards headpiece 30, it will be recognized that it would be equally effective to force the lower end 36*b* of rod 32*a* away from headpiece 30 to accomplish the same result. Moreover, other means of maintaining tension on rod 32*a*, such as by spring-actuated connection (not shown) to opposite rod 32*c*, will also be effective.

By the production of a traffic barrier system 10 which does not require mechanized components and allows for easy replacement of flexible material 20, the disadvantages of prior art crowd control systems, namely breakage of mechanized parts, are avoided, and the replacement of frayed or worn flexible material is more facilely accomplished. In addition, since flexible material 20 is not housed inside a mechanized housing, the limits on length of prior art barrier systems are avoided.

The above description is for the purpose of teaching the person of ordinary skill in the art how to practice the present invention, and it is not intended to detail all of those obvious modifications and variations of it which will become apparent to the skilled worker upon reading the description. It is intended, however, that all such obvious modifications and variations be included within the scope of the present invention which is defined by the following claims.

What is claimed is:

1. An adjustable length traffic barrier system comprising:

a) an elongated strip of flexible material having a first end portion, a second end portion and an intermediate segment disposed therebetween, said second end portion having a first element of an attachment means disposed thereat, and wherein a complementary element or elements of said attachment means is disposed along said intermediate segment so as to permit attachment of said second end portion at a plurality of locations on said intermediate segment;

b) a first headpiece having at least one means associated therewith to engage and thereby attach thereto said first end portion of said flexible material; and c) a second headpiece having at least one means associated therewith to engage and thereby attach thereto said flexible material, wherein said flexible material extends from said first headpiece to said second headpiece and said first and second headpieces being spaced and supported along a pedestrian traffic area.

2. The barrier system of claim 1 wherein said first end portion is removably engaged by said first headpiece.

3. The barrier system of claim 2 wherein said means associated with said first headpiece comprises at least one rod depending from said first headpiece; and further wherein said first end of said flexible material is formed into a loop which is disposed about said rod.

4. The barrier system of claim 3 wherein said means associated with said second headpiece comprises at least one rod depending from said second headpiece, about which said flexible material is looped.

5. The barrier system of claim 4 wherein each of said rods is canted relative to the direction of extension of said flexible material at an angle less than 90° to maintain tension on said flexible material.

6. The barrier system of claim 1 wherein said attachment means is selected from the group consisting of hook and loop fastening systems, buttons, snaps, zippers, hook and eye fastening systems, tabular clasps, and combinations thereof.

7. The barrier system of claim 1 wherein said first and second headpieces are each disposed on stanchions.

8. The barrier system of claim 7 wherein said first and second headpieces are each removably disposed on stanchions.

9. The barrier system of claim 1 wherein each of said first and second headpieces is constructed of a material selected from the group consisting of brass, chrome, steel, wood, aluminum, a dimensionally stable plastic material, and combinations thereof.

10. A non-mechanized traffic barrier system comprising:

a) an elongated strip of flexible material having a first end portion, a second end portion, and an intermediate segment disposed therebetween, said second end portion having a first element of an attachment means disposed thereat, and wherein a complementary element or elements of said attachment means is disposed along said intermediate segment so as to permit attachment of said second end portion at a plurality of locations on said intermediate segment;

b) a first stationary structure having at least one means associated therewith to engage and thereby attach thereto said first end portion of said flexible material; and c) a second stationary structure having at least one means associated therewith to engage and thereby attach thereto said flexible material, wherein said flexible material extends from said first stationary structure to said second stationary structure and said first and second stationary structures being spaced and supported along a traffic area.

11. The barrier system of claim 10 wherein said first stationary structure comprises a first headpiece and said second stationary structure comprises a second headpiece.

12. The barrier system of claim 11 wherein said first end portion of said flexible material is removably engaged by said first headpiece.

13. The barrier system of claim 12 wherein said means associated with said first headpiece comprises at least one rod depending from said headpiece; and further wherein said first end portion of said flexible material is formed into a loop which is disposed about said rod.

14. The barrier system of claim 11 wherein said means associated with said second headpiece comprises at least one rod depending from said second headpiece, about which said flexible material is looped.

15. The barrier system of claim 13 wherein each of said rods is canted relative to the direction of extension of said flexible material at an angle less than 90° to maintain tension on said flexible material.

16. The barrier system of claim 14 wherein each of said rods is canted relative to the direction of extension of said flexible material at an angle less than 90° to maintain tension on said flexible material.

17. The barrier system of claim 10 wherein said attachment means is selected from the group consisting of hook and loop fastening systems, buttons, snaps, zippers, hook and eye fastening systems, tabular clasps, and combinations thereof.

18. The barrier system of claim 11 wherein each of said headpieces is removably disposed on a stanchion.

* * * * *